United States Patent [19]

Walter

[11] Patent Number: 4,892,115

[45] Date of Patent: Jan. 9, 1990

[54] CONTROL VALVE ASSEMBLY

[75] Inventor: John Walter, Evergreen Park, Ill.

[73] Assignee: Continental Can Company, Inc., Norwalk, Conn.

[21] Appl. No.: 207,509

[22] Filed: Jun. 16, 1988

[51] Int. Cl.[4] ..... G16K 11/00

[52] U.S. Cl. ..... 137/269; 251/367

[58] Field of Search ..... 137/269, 271, 884; 251/367

[56] References Cited

U.S. PATENT DOCUMENTS 2,879,788 3/1959 Bechett et al. ..... 251/367 X
3,888,518 6/1975 Delevert ..... 137/271 X

FOREIGN PATENT DOCUMENTS 55-112461 8/1980 Japan ..... 137/884
2176270 12/1986 United Kingdom ..... 137/884

*Primary Examiner*—John Fox
*Attorney, Agent, or Firm*—Charles E. Brown; Paul Shapiro; Charles A. Brown

[57] ABSTRACT

This relates to a compact control valve assembly which is particularly intended to be mounted for controlling and operating a station of a multiple station machine such as a container closing machine. The compactness of the valve assembly is made possible by forming a required manifold of an L-shaped configuration including a base and an upstanding part. A first control valve is mounted on the rear wall of the upstanding part to control the flow of fluid through the manifold. Other control valves are mounted on the top wall of the base of the manifold and clamped against a front wall of the upstanding part of the manifold for controlling other operations. By making the manifold L-shaped and fitting the other control valves therein, the entire valve assembly is a compact unit.

18 Claims, 1 Drawing Sheet

FIG. 1
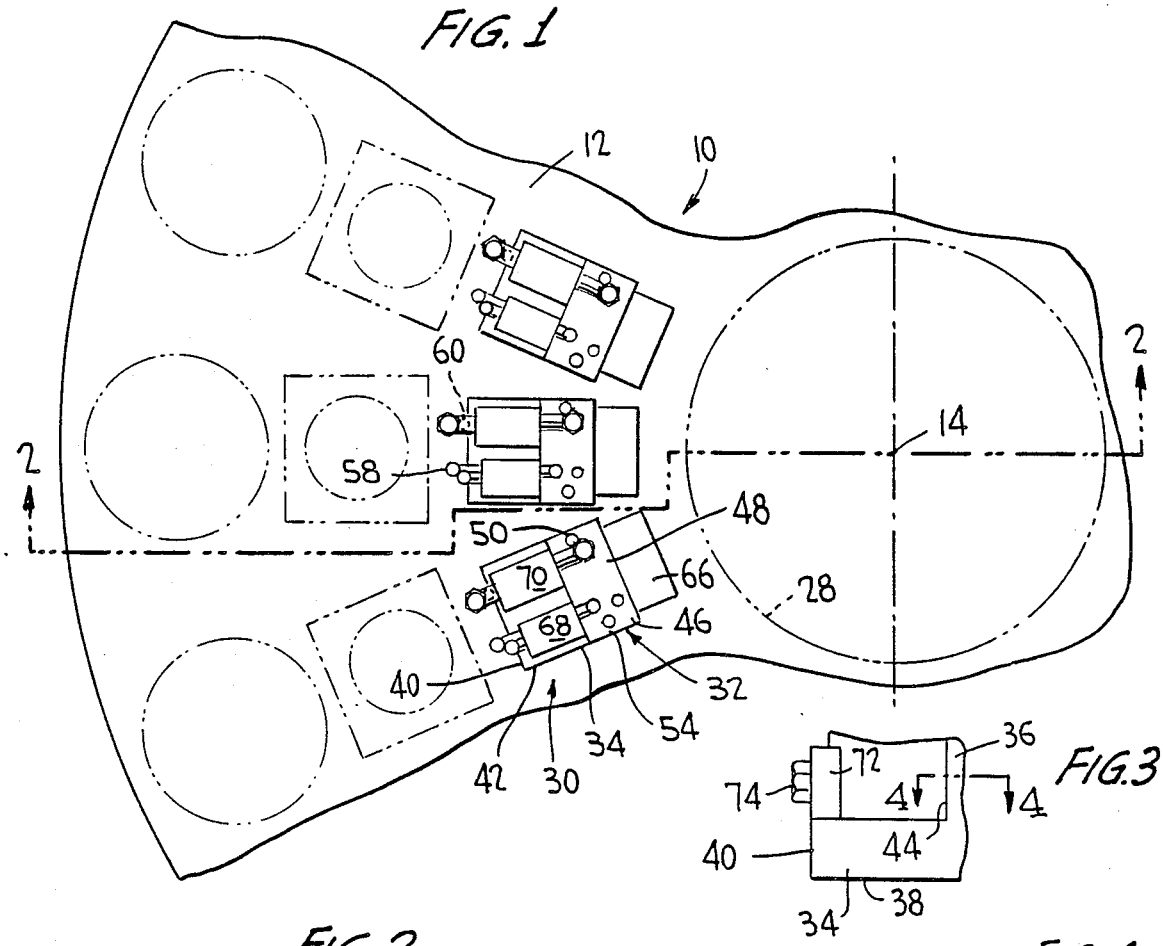
FIG. 3
FIG. 2
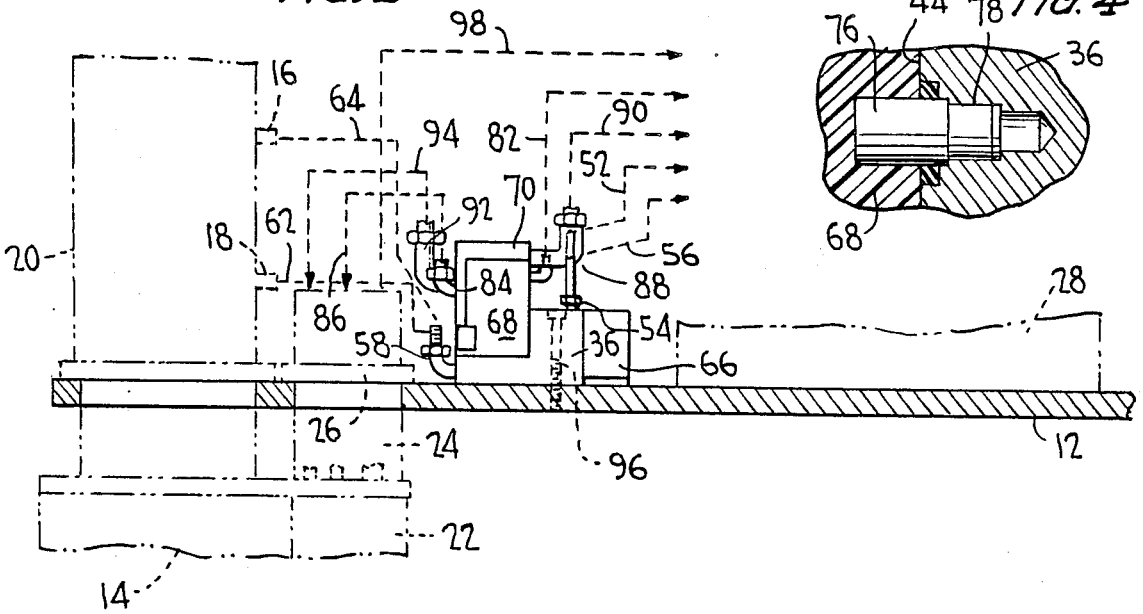
FIG. 4
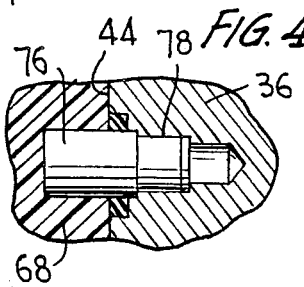

CONTROL VALVE ASSEMBLY

This invention relates in general to new and useful improvements in control valve assemblies, and more particularly to a compact control valve assembly for use in a multiple station machine.

In particular, this invention relates to a compact control valve assembly for a multiple station machine of the rotary type wherein the machine has a plurality of work heads the operation of which is independently controlled by a control valve assembly. It will be readily apparent that in such a machine, the alloted space for such a control valve assembly is relatively small.

Most particularly, in accordance with this invention, there is provided a compact control valve assembly which includes a manifold. The manifold is generally L-shaped and has flow passages therethrough. By making the manifold of an L-shaped configuration in elevation, control valves may be readily seated and mounted on the manifold at least partially within the confines of the manifold.

In accordance with the invention, the L-shaped cross sectional manifold includes a base and an upstanding part with the base having a top wall and the upstanding part having an adjacent front wall. A control valve is seated on the base top wall and against the upstanding part front wall. If desired, the control valve may be positioned on the manifold by way of a clamp plate, clamping the control valve against the front wall of the upstanding part. In addition, there may be a pin and socket type connection between the control valve and the manifold upstanding part.

Further, the manifold may have a flow therethrough controlled by a control valve which is mounted on the rear wall of the upstanding part and internally coupled therewith.

Most particularly, in a preferred embodiment of the invention, the compact control valve assembly is utilized in conjunction with a container closing machine which includes a sealing head positioned by way of an extensible fluid motor and which sealing head includes a vacuum cup for retaining and positioning a lid with respect to a container and vacuum means for drawing a vacuum within the container prior to closing. The manifold and the associated control valve controls the operation of the extensible fluid motor while the control valves seated on the manifold controls the coupling of the vacuum cup and the sealing head to a vacuum source.

Other advantages and characteristics of the invention will appear from a reading of the following description, given purely by way of illustration and example, with reference to the accompanying drawings, in which:

FIG. 1 is a schematic fragmentary plan view of a support plate of a rotary machine having mounted thereon several of the compact control valve assemblies which are the subject of this invention.

FIG. 2 is a schematic fragmentary vertical sectional view taken generally along the line 2—2 of FIG. 1 and shows further the details of the valve assembly.

FIG. 3 is an enlarged fragmentary elevational view showing the manner in which a valve seated on the base of the manifold is clamped against an upstanding part of the manifold FIG. 4 is an enlarged fragmentary horizontal sectional view showing a pin and socket locator connection between a control valve and the upstanding part of the manifold.

Referring now to the drawings in detail, it will be seen that there has been schematically illustrated portions of a container closing machine, which machine is generally identified by the numeral 10. The machine 10 includes a support plate 12 which is mounted for rotation about an axis 14. The support plate 12 has a plurality of work stations carried thereby and each work station includes a sealing head generally identified by the numeral 14. The sealing head 14 is carried by an extensible fluid motor of which only fluid lines 16 and 18 are shown. The fluid motor is mounted for guided vertical movement within a guide sleeve 20 which is fixedly mounted on the support plate 12.

There is associated with each sealing head 14 a supply unit 22 for supplying separate vacuums, inert gas and electrical connections to the sealing head. The supply unit 22 is carried by an upstanding supply tube 24 which is guided in a fitting 26 fixedly carried by the support plate 12.

A housing 28 extends upwardly from the support plate 12 and carries a plurality of rotary valves (not shown) which do not per se form a part of this invention. In order to provide for the necessary vacuum supplies to the sealing head 14 and to actuate the extensible fluid motor which carries the sealing head, a separate control valve assembly is required for each work station. Such control valve assembly is the subject of this invention and is most specifically identified by the reference numeral 30. The control valve assembly 30 includes a manifold 32 which is L-shaped in side elevation and includes a base 34 and an integral upstanding part 36.

The base 34 includes a bottom wall 38, a front wall 40 and a partial top wall 42. The upstanding part 36 of the manifold has a front wall 44, a top wall 46 and a rear wall 48.

It is to be understood that the manifold has two sets of conduits (not shown) extending therethrough and opening through the upstanding part 36 top wall 46 and rear wall 48 and the base front wall 40. A fitting 50 for supplying fluid under pressure into the manifold 32 through a fluid line 52 coupled to one of the rotary valves is carried by the top wall 46. A similar fitting 54 is carried by the top wall 46 and coupled to an internal conduit of the manifold 32 for connecting the manifold 32 to a return line 56 which, in turn, is coupled to a rotary valve.

Two fittings 58, 60 are carried by the front wall 40 of the base 34 in communication with the internal conduits of the manifold 32 and are coupled to lines 62, 64, respectively, which are connected to the fluid lines 18, 16 of the extensible fluid motor.

In order that the flow of fluid through the manifold conduits may be controlled to selectively extend and retract the extensible fluid motor, there is mounted on the rear wall 48 of the upstanding part 36 a control valve 66 which is in communication with the internal conduits of the manifold 32. The control valve 66 is a conventional electrically controlled valve.

There is also seated on the top wall 42 of the base 34 a pair of control valves 68, 70. In a preferred mounting of each of the control valves 68, 70 each control valve is clamped against the front wall 44 of the upstanding part 36 by means of a clamp plate 72 which is clamped against the front of the associated control valve 60 or 70. The clamp plate 72 is positioned by means of an elongated fastener 74 which extends through the clamp plate 72, a lower portion of the respective one of the control valves and into the upstanding part 36, as is best shown in FIG. 3.

Further, in order to laterally position each of the control valves 68, 70 on the manifold 32, there are locator means between the area portion of each of the control valves 68 and 70 on the one hand, and the upstanding part 36 on the other hand. As is best shown in FIG. 4, these locator means are preferably in the form of a pin 76 extending rearwardly from the respective one of the control valves 68, 70 seating in a socket 78 formed in the front part of the upstanding part 36.

For description purposes, it is to be noted that the rear of the control valve 68 is provided with a fitting 80 coupling a line 82 to one of the rotary valves or unions which, in turn, is connected to a vacuum source. The front of the control valve 68 is provided with a fitting 84 which connects a vacuum line 86 which leads from the control valve 68 to a vacuum chamber in the sealing head 14. Further, the control valve 70 is provided at the rear thereof with a fitting 88 which couples to the valve 70 a flow line 90 which extends from a rotary valve also coupled to a vacuum source. The front of the control valve 70 is provided with a fitting 92 which connects to the valve 70 a line 94 which leads to the vacuum cups (not shown) carried by the sealing head 14.

It is to be understood that the control valves 68, 70 like the control valve 66 will be electrically energized. Finally, it is to be understood that the bottom wall 38 of the base of the manifold 32 will be seated on the support plate 12 and clamped there against by a pair of bolts 96 which extend downwardly through the upstanding part 36 of the manifold 32 and are threaded into the support plate 12 as is best shown in FIG. 2 so that the valve assemblies 30 may be readily replaced. It is to be also understood that the control valves 66, 68 and 780 may also readily replaced.

There may also be a line 98 for an inert gas that does not go through the control valve assembly, but is connected to the supply unit 22 at one end and a rotary valve at the opposite end.

Although only a preferred embodiment of the compact control valve assembly has been specifically illustrated and described herein, it is to be understood that minor variations may be made therein without departing from the spirit and ccope of the invention as defined by the appended claims.

I claim:

1. A compact valve assembly for a multiple station machine, said valve assembly comprising a manifold including a base and an upstanding part integral with said base wherein said manifold is L-shaped in end elevation, said base having a front wall, a top wall, and a bottom wall, said upstanding part having a front wall, a rear wall and a top wall, said manifold having fluid passages extending through said base and said upstanding part, a first control valve mounted on said upstanding part rear wall and coupled to said fluid passages for controlling flow through said manifold, and said manifold forming a mounting support for at least one other control valve.

2. A compact valve assembly according to claim 1 wherein said at least one other control valve is seated on said base top wall at said upstanding part front wall.

3. A compact valve assembly according to claim 2 wherein there are clamp means clamping said at least one other control valve against said upstanding part front wall.

4. A compact valve assembly according to claim 3 wherein there are locator means for said at least one other control valve between said at least one other control valve and said upstanding part.

5. A compact valve assembly according to claim 4 wherein said locator means is in the form of a pin and socket connection.

6. A compact valve assembly according to claim 2 wherein there are locator means for said at least one other control valve between said at least one other control valve and said upstanding part.

7. A compact valve assembly according to claim 6 wherein said locator means is in the form of a pin and socket connection.

8. A compact valve assembly according to claim 2 wherein there are at least two of said other control valves, said two other control valves being seated on said base top wall in side-by-side relation.

9. A compact valve assembly according to claim 8 wherein said two other control valves have functions separate and apart from said first control valve and said manifold.

10. A compact valve assembly according to claim 8 wherein said two other control valves have functions separate and apart from said first control valve and said manifold and each other.

11. A compact valve assembly according to claim 2 wherein said other control valve has functions separate and apart from said first control valve and said manifold.

12. A compact valve assembly for a multiple station machine, said valve assembly comprising a manifold including a base and an upstanding part integral with said base wherein said manifold is L-shaped in end elevation, said base having a front wall, a top wall, and a bottom wall, said upstanding part having a front wall, a rear wall and a top wall, and a control valve seated on said base top wall at said upstanding part front wall.

13. A compact valve assembly according to claim 12 wherein there are clamp means clamping said control valve against said upstanding part front wall.

14. A compact valve assembly according to claim 13 wherein there are locator means for said control valve between said control valve and said upstanding part.

15. A compact valve assembly according to claim 14 wherein said locator means is in the form of a pin and socket connection.

16. A compact valve assembly according to claim 12 wherein said control valve has a function separate and apart from said manifold.

17. A compact valve assembly according to claim 12 wherein there are at least two of said contral valves seated on said manifold in side-by-side relation.

18. A compact valve assembly according to claim 8 wherein said first control valve and said manifold form control means for actuating an extensible fluid motor, and said other control valves control flow through separate vacuum lines.

* * * * *